US009274454B2

(12) United States Patent
Yang et al.

(10) Patent No.: US 9,274,454 B2
(45) Date of Patent: Mar. 1, 2016

(54) CHIP CONTACT MECHANISM AND DEVELOPER CARTRIDGE

(71) Applicant: PRINT-RITE • UNICORN IMAGE PRODUCTS CO., LTD. OF ZHUHAI, Zhuhai (CN)

(72) Inventors: Xiaofeng Yang, Zhuhai (CN); Congyu Qiu, Zhuhai (CN); Wugang Tan, Zhuhai (CN)

(73) Assignee: PRINT-RITE • UNICORN IMAGE PRODUCTS CO., LTD. OF ZHUHAI (CN)

( * ) Notice: Subject to any disclaimer, the term of this patent is extended or adjusted under 35 U.S.C. 154(b) by 0 days.

(21) Appl. No.: 14/380,187

(22) PCT Filed: Feb. 6, 2013

(86) PCT No.: PCT/CN2013/071433

§ 371 (c)(1),
(2) Date: Aug. 21, 2014

(87) PCT Pub. No.: WO2013/123858

PCT Pub. Date: Aug. 29, 2013

(65) Prior Publication Data

US 2015/0037059 A1 Feb. 5, 2015

(30) Foreign Application Priority Data

Feb. 23, 2012 (CN) ..... 2012 1 0042670

(51) Int. Cl.
*G03G 15/08* (2006.01)

(52) U.S. Cl.
CPC ..... *G03G 15/0863* (2013.01)

(58) Field of Classification Search
CPC ..... G03G 15/0863
See application file for complete search history.

(56) References Cited

U.S. PATENT DOCUMENTS

| | | | | |
|---|---|---|---|---|
| 6,588,871 | B2 * | 7/2003 | Studholme et al. | 347/19 |
| 2002/0025185 | A1 * | 2/2002 | Ito et al. | 399/111 |
| 2003/0091361 | A1 * | 5/2003 | Noda et al. | 399/90 |
| 2003/0215261 | A1 * | 11/2003 | Karakama et al. | 399/111 |
| 2008/0018705 | A1 * | 1/2008 | Muhl | 347/49 |
| 2010/0007700 | A1 * | 1/2010 | Muhl | 347/49 |
| 2012/0106985 | A1 * | 5/2012 | Tanaka | 399/12 |
| 2012/0321341 | A1 * | 12/2012 | Hori et al. | 399/110 |
| 2013/0343777 | A1 * | 12/2013 | Amann et al. | 399/90 |

FOREIGN PATENT DOCUMENTS

| | | |
|---|---|---|
| CN | 201194071 Y | 2/2009 |
| CN | 101923307 A | 12/2010 |

(Continued)

OTHER PUBLICATIONS

International Search Report for Application No. PCT/CN2013/071433 dated Apr. 11, 2013.

*Primary Examiner* — Clayton E LaBalle
*Assistant Examiner* — Ruifeng Pu
(74) *Attorney, Agent, or Firm* — Lerner, David, Littenberg, Krumholz & Mentlik, LLP

(57) ABSTRACT

Disclosed is a chip contact mechanism for a developer cartridge. The chip contact mechanism comprises a chip holder movably provided on the developer cartridge and a lever for enabling the chip holder to move. The chip holder is provided with a chip installation position. A return member is provided between the chip holder and the cartridge body. Disclosed is also a developer cartridge which comprises the chip contact mechanism.

4 Claims, 7 Drawing Sheets

(56) References Cited

FOREIGN PATENT DOCUMENTS

| | | | | | |
|---|---|---|---|---|---|
| CN | 102540822 | A | | 7/2012 | |
| JP | 09179476 | | | 7/1997 | |
| JP | 03461330 | B2 | | 10/2003 | |
| JP | 03774691 | B2 | | 5/2006 | |
| JP | 3173565 | | * | 1/2012 | ..... B41J 3/04 |

* cited by examiner

CHIP CONTACT MECHANISM AND DEVELOPER CARTRIDGE

CROSS-REFERENCE TO RELATED APPLICATIONS

The present application is a national phase entry under U.S.C. §371 of International Application No. PCT/CN2013/071433 filed on Feb. 6, 2013, which claims priority from Chinese Application No. 201210042670.0 filed on Feb. 23, 2012, all of which are hereby incorporated by reference herein.

TECHNICAL FIELD OF THE INVENTION

The present invention relates to a developer cartridge detachably mounted in an image forming apparatus. Furthermore, the present invention relates to a chip contact mechanism for the developer cartridge.

TECHNICAL BACKGROUND

Electrophotographic imaging forming apparatus such as laser printers, utilizing the principle of electronic photography, which at least involve charging, exposing, developing, transferring, fixing, and cleaning processes to form images on the medium such as paper. The imaging forming apparatus usually use detachable developer cartridges to complete the above processes.

In the charging process, a photosensitive member, such as photosensitive drum, is uniformly charged with a given amount of charge by a corona discharge method or by using a charging roller. In the exposure process, the surface of the charged photosensitive member is selectively exposed. Due to the photosensitive characteristics of the photosensitive member, the charge of the exposed region disappears by grounding. Therefore, after exposure, an electrostatic latent image is formed on the surface of the photosensitive member through the distribution of charge which corresponds to the designed image. In the developing process, the developing device, such as the developing roller, transfers the developer, such as toner, to the electrostatic latent image region with the force, such as the electric force, to visualize the electrostatic latent image. In the transferring process, the transferring device, such as the transfer roller, transfers the developer of the electrostatic latent image on the photosensitive member surface to the imaging medium such as paper. In the fixing process, the image fixing device firmly fixes the developer onto the imaging medium. In the cleaning process, the cleaning device, such as the wiper blade, removes the residual developer from the surface of the photosensitive member to avoid printing defects in the next image forming cycle.

Conventional developer cartridges usually have a toner hopper unit and a waste bin unit. The toner hopper unit comprises a developing roller, a doctor blade, a toner adder roller and an agitating frame. The waste bin unit comprises a photosensitive drum, a charging roller and a wiper blade. Some developer cartridges only have a toner hopper unit, but do not have waste bin units. In the prior art, some developer cartridges are provided with chip contact mechanisms which are fixed on the cartridge body. The chip contact mechanism has a chip installation position and the chip is fixed on the chip installation position. When the developer cartridge is installed inside the printer, the chip on the developer cartridge is in contact with the contact inside the printer, the circuit is turned on, and the developer cartridge starts working. However, this method creates relatively high impact on the contact of the imaging forming apparatus which may damage the contact of the imaging forming apparatus, resulting in poor contacting and interference with the work of the developer cartridge.

DESCRIPTION OF THE INVENTION

The first objective of the present invention is to overcome the deficiencies of the prior art and to provide a chip contact mechanism for developer cartridges which can prevent the contact of the imaging forming apparatus from being damaged by excessive impact when the developer cartridge is being installed.

The second objective of the present invention is to provide a developer cartridge which comprises the chip contact mechanism of the present invention.

To achieve the first objective, the present invention provides a chip contact mechanism on a developer cartridge; the chip contact mechanism comprises a chip holder which is movably provided on the cartridge body of the developer cartridge and a lever for enabling the chip holder to move. The chip holder has a chip installation position; a return member is provided between the chip holder and the cartridge body.

Further, the lever is hinged with the cartridge body and abuts against the chip holder; when an external force is applied to the lever, the lever rotates from an initial position to a working position while pushing the chip holder to move from a chip non-contact position to a chip contact position; and when the external force is released, the chip holder moves back from the chip contact position to the chip non-contact position by the return member while pushing the lever to rotate from the working position to the initial position.

Preferably, the return member is a spring. The chip holder comprises a spring base board. The spring base board is provided with a spring positioning post which extends from the spring base board. The spring is disposed around the spring positioning post. The rear end of the spring presses against the spring base board or is fixed on the spring positioning post. The front end of the spring presses against a spring baffle plate which projects on the cartridge body.

Preferably, the cartridge body is provided with a sliding groove. The sliding groove engages with the chip holder. The chip holder is provided slidably within the sliding groove. Both sides of the chip holder are provided with guiding pins. Both sides of the sliding groove are provided with guide rails engaging with the guiding pins. The sliding groove is provided with a restricting block above the chip holder to prevent the chip holder from leaving the sliding groove.

To achieve the second objective, the present invention provides a developer cartridge which comprises a cartridge body and a chip contact mechanism. The chip contact mechanism comprises a chip holder which is movably provided on the cartridge body and a lever for enabling the chip holder to move. The chip holder has a chip installation position. A return member is provided between the chip holder and the cartridge body.

Further, the lever is hinged with the cartridge body and abuts against the chip holder. When an external force is applied to the lever, the lever rotates from an initial position to a working position while pushing the chip holder to move from a chip non-contact position to a chip contact position. When the external force is released, the chip holder moves back from the chip contact position to the chip non-contact position by the return member while pushing the lever to rotate from the working position to the initial position.

Preferably, the return member is a spring. The chip holder has a spring base board. The spring base board is provided with a spring positioning post which extends from the spring base board. The spring is disposed around the spring positioning post. The rear end of the spring presses against the spring base board or is fixed on the spring positioning post. The front end of the spring presses against a spring baffle plate which projects on the cartridge body.

Preferably, the cartridge body is provided with a sliding groove engaging with the chip holder. The chip holder is provided slidably within the sliding groove. Both sides of the chip holder are provided with guiding pins. Both sides of the sliding groove are provided with guide rails engaging with the guiding pins. The sliding groove is provided with a restricting block above the chip holder to prevent the chip holder from leaving the sliding groove.

The advantageous effects of the present invention are as follows. When the developer cartridge comprising the chip contact mechanism is being installed into the printer, the chip and the contact of the printer are disconnected. When the printer cover is closed, the cover pushes the lever, and the lever then pushes the chip holder to move against the spring force to a working position; the chip and the contact of the printer are connected; and the developer cartridge starts to work. When the printer cover is open, the chip holder moves back to the initial position by the spring force; the chip is disconnected with the contact of the printer; and the developer cartridge can easily be removed. Because the connection of the chip with the contact of the imaging forming apparatus is accomplished by mechanical structure, this design of the present invention prevents the contact of the imaging forming apparatus from being damaged by excessive impact during the installation of the developer cartridge.

EMBODIMENTS OF THE INVENTION

Figure 1:
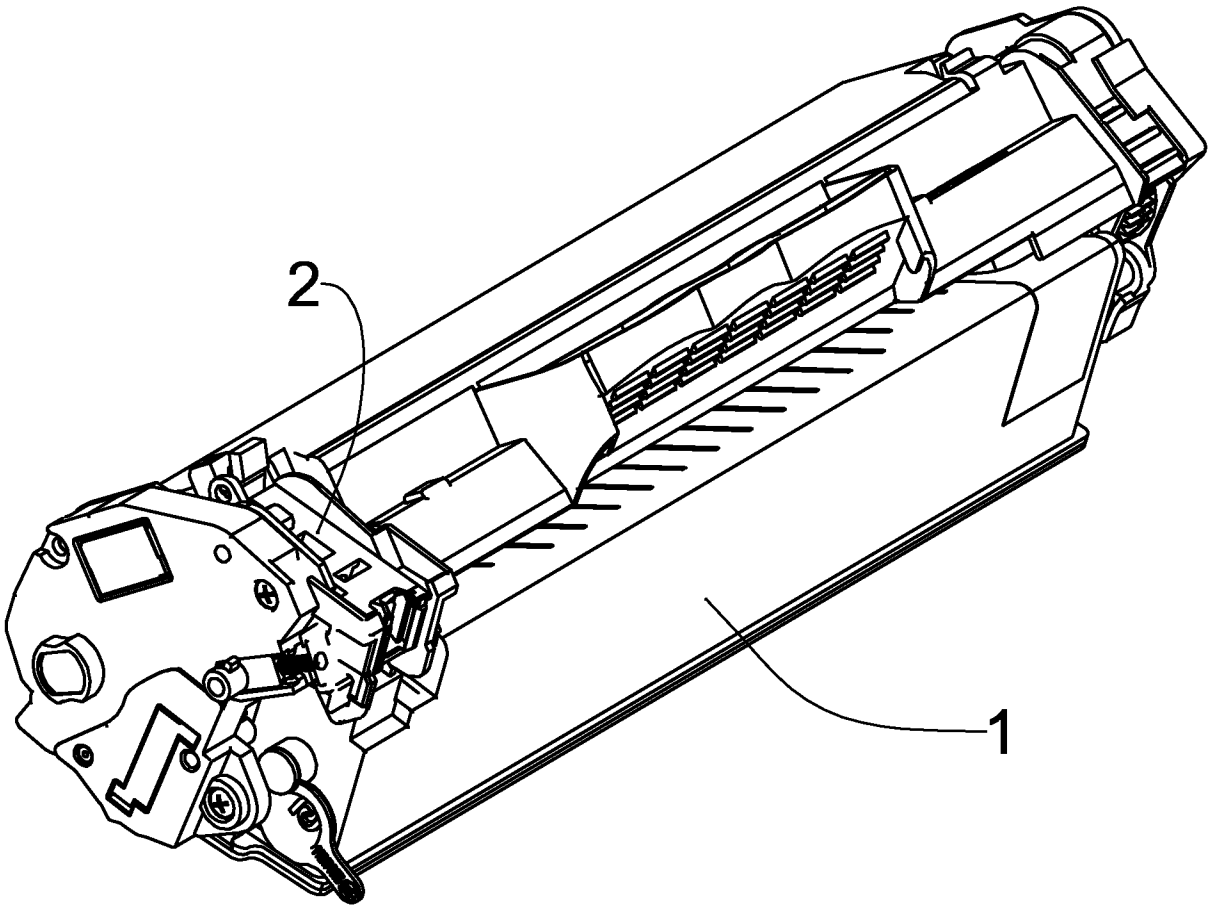
FIG. 1 is a perspective view of a developer cartridge according to the present invention.

FIG. 1 shows a developer cartridge. The developer cartridge comprises the cartridge body 1 and the chip contact mechanism 2. The cartridge body 1 and its internal structure are similar to the conventional developer cartridges. It mainly comprises a toner hopper unit and a waste bin unit. The toner hopper unit comprises a developing roller, a doctor blade, a toner adder roller and an agitating frame etc. The waste bin unit comprises a photosensitive drum, a charging roller and a wiper blade etc. Of course, the cartridge body 1 can have the toner hopper unit only and does not have the waste bin unit. Since the internal structure of the cartridge body 1 is not critical to the spirit of the present invention, the following description focus only on the contact mechanism 2.

Figure 2:
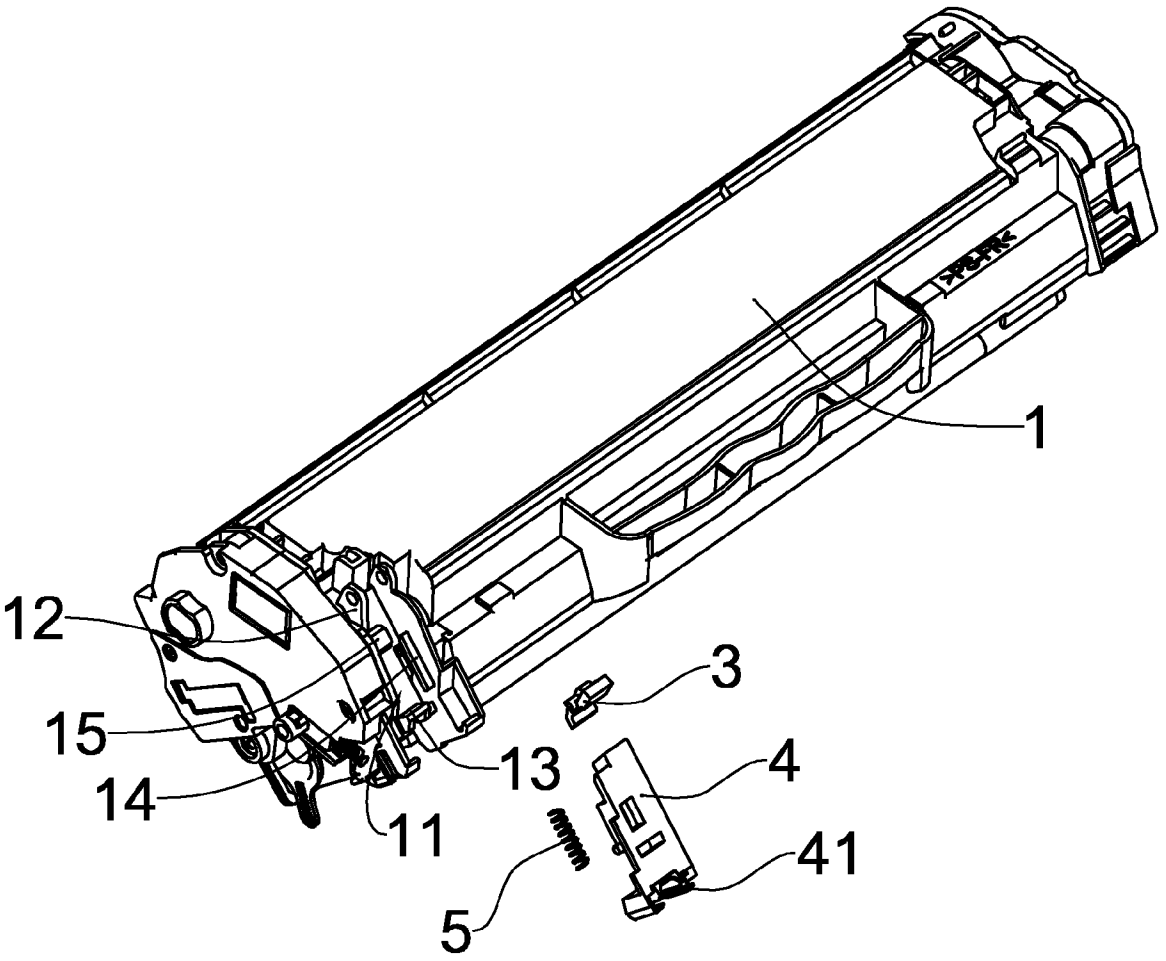
FIG. 2 is a partial exploded view of the developer cartridge shown in FIG. 1.
Figure 3:
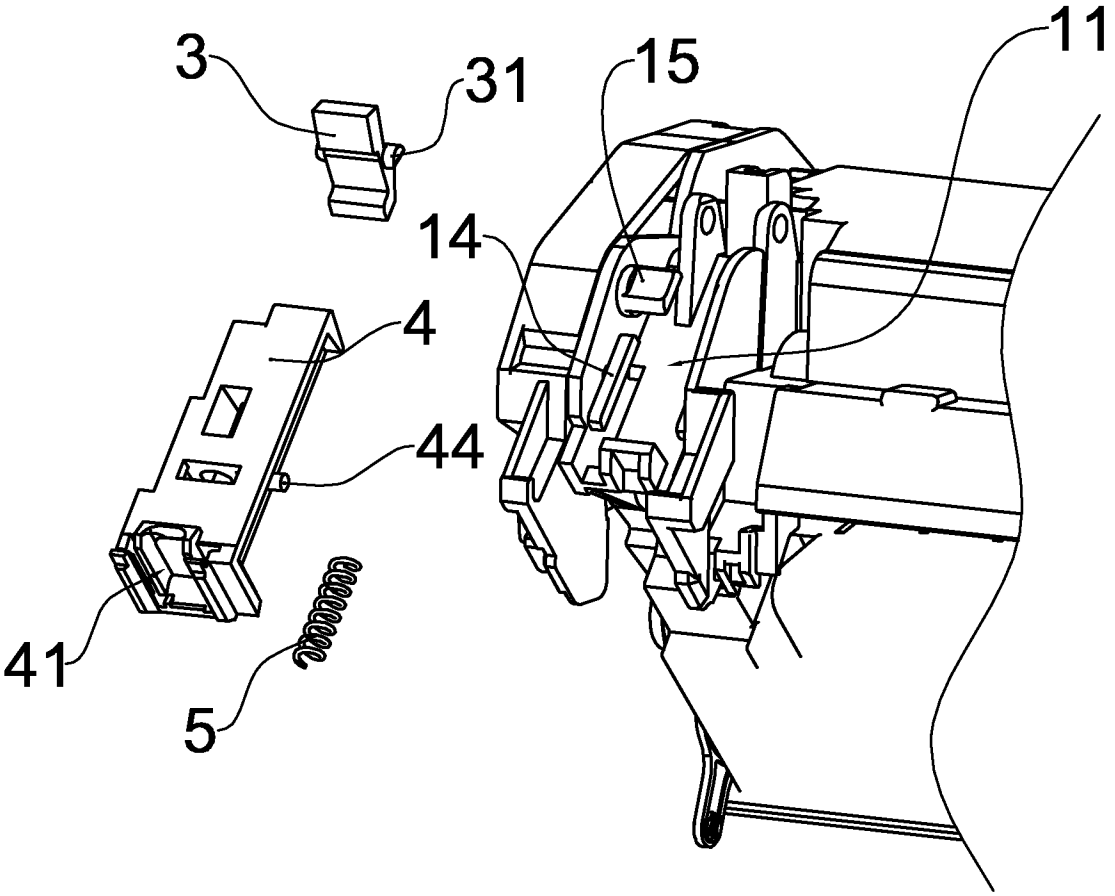
FIG. 3 is another partial exploded view of the developer cartridge shown in FIG. 1.
Figure 4:
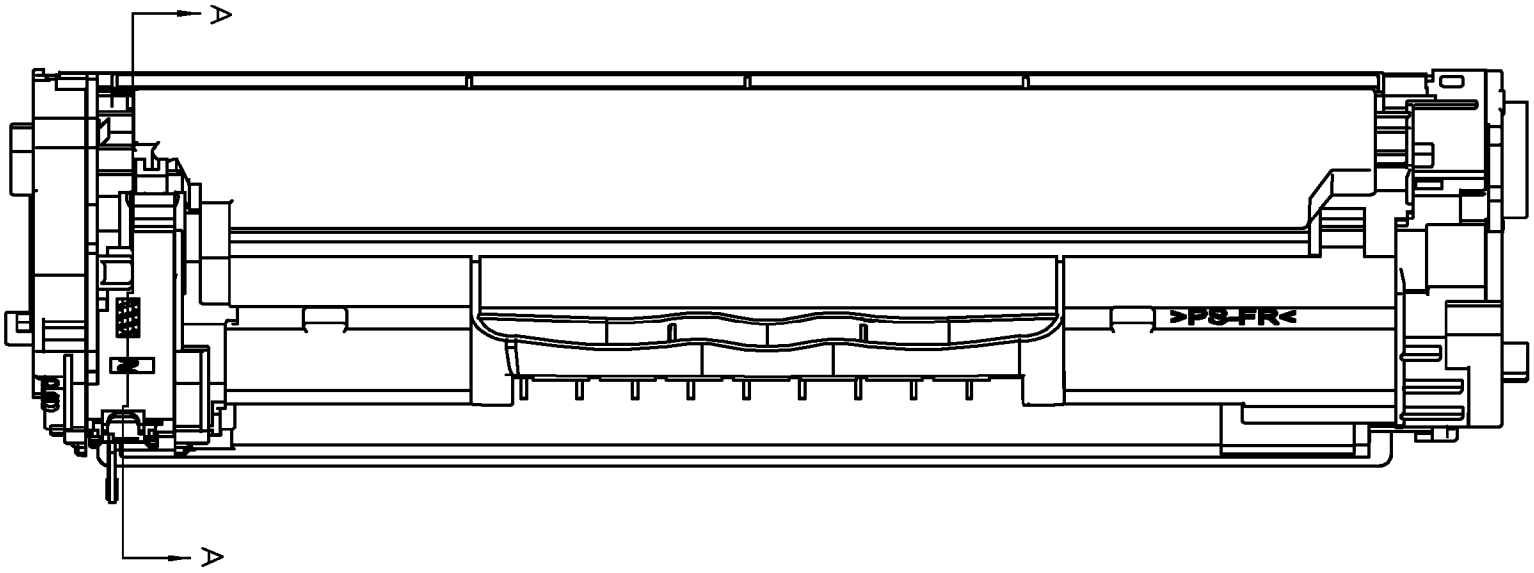
FIG. 4 is a top view of the developer cartridge shown in FIG. 1.
Figure 5:
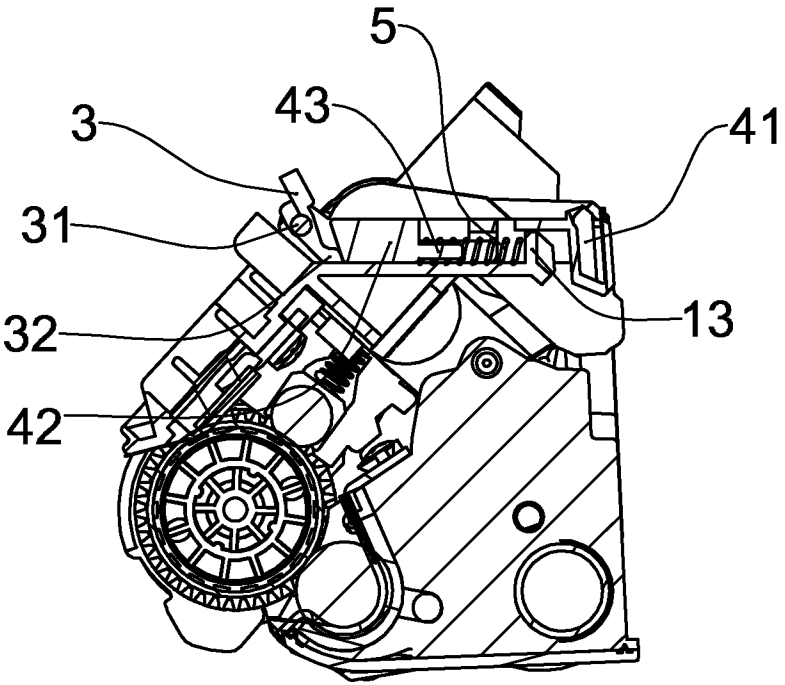
FIG. 5 is an A-A sectional view of the developer cartridge shown in FIG. 1 when the chip contact mechanism is on the initial position.

As shown in FIG. 2 and FIG. 3, the chip contact mechanism 2 comprises the lever 3, the chip holder 4, and the spring 5, which can be separated from each other. The cartridge body 1 is provided with the sliding groove 11 engaging with the chip holder 4. The chip holder 4 can slide in the sliding groove 11. The front end of the chip holder 4 is provided with the chip installation position 41 which is used to fix the chip 6 (see FIG. 7 and FIG. 8). As shown in FIG. 5, the lever 3 is hinged with the lever base 12 of the cartridge body 1 via the shaft 31 and it can rotate around the shaft 31 relative to the lever base 12. The low end 32 of the lever 3 abuts against the rear end of the chip holder 4. When the lever 3 rotates counterclockwise, the low end 32 of the lever 3 swings forward, and the lever 3 pushes the chip holder 4 to slide forward. The chip holder 4 is provided with the spring base board 42, and the inner surface of the spring base board 42 is provided with a spring positioning post 43 extending from the spring base board. The spring 5 is disposed around the spring positioning post 43. The rear end of the spring 5 presses against the inner surface of the spring base board 42. Alternatively, the spring 5 is fixed on the spring positioning post 43. The front end of the spring 5 presses against the spring baffle plate 13 which is projected on cartridge body 1. The guiding pins 44 are projected on both sides of the chip holder 4. Both sides of the sliding groove 11 are provided with the guide rails 14 engaging with the guiding pins 44. The guiding pins 44 can slide along the lower surface of the guide rails 14. The sliding groove 11 is provided with a restricting block 15 above the chip holder 4 to prevent the chip holder 4 from leaving the sliding groove 15.

When an external force is applied to the lever 3, the lever 3 rotates from the initial position to the working position and pushes the chip holder 4 to slide from the chip non-contact position to the chip contact position. When the external force is released, the chip holder 4 slides back from the chip contact position to the chip non-contact position by the spring force and pushes the lever 3 to rotate from the working position to the initial position.

Figure 6:
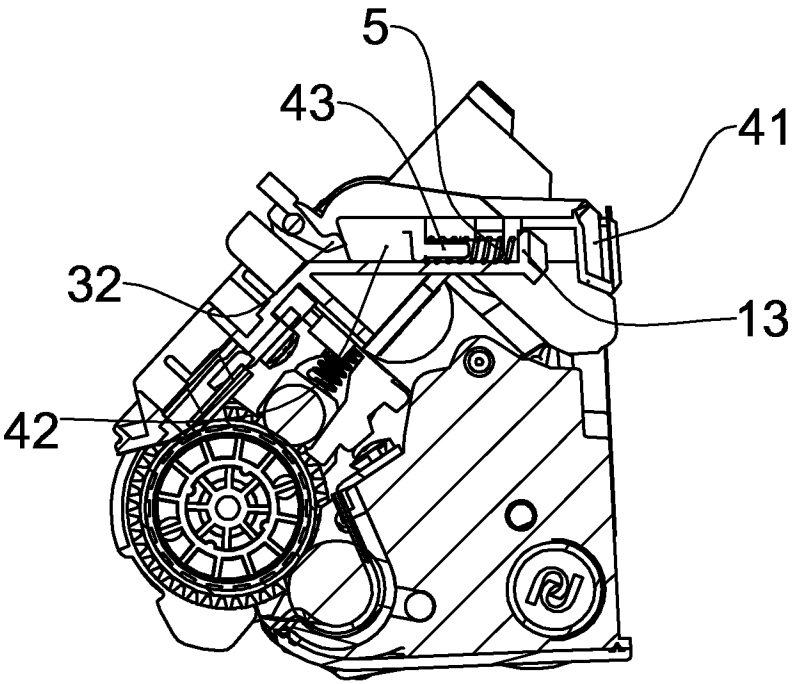
FIG. 6 is an A-A sectional view of the developer cartridge shown in FIG. 1 when the chip contact mechanism is on the working position.
Figure 7:
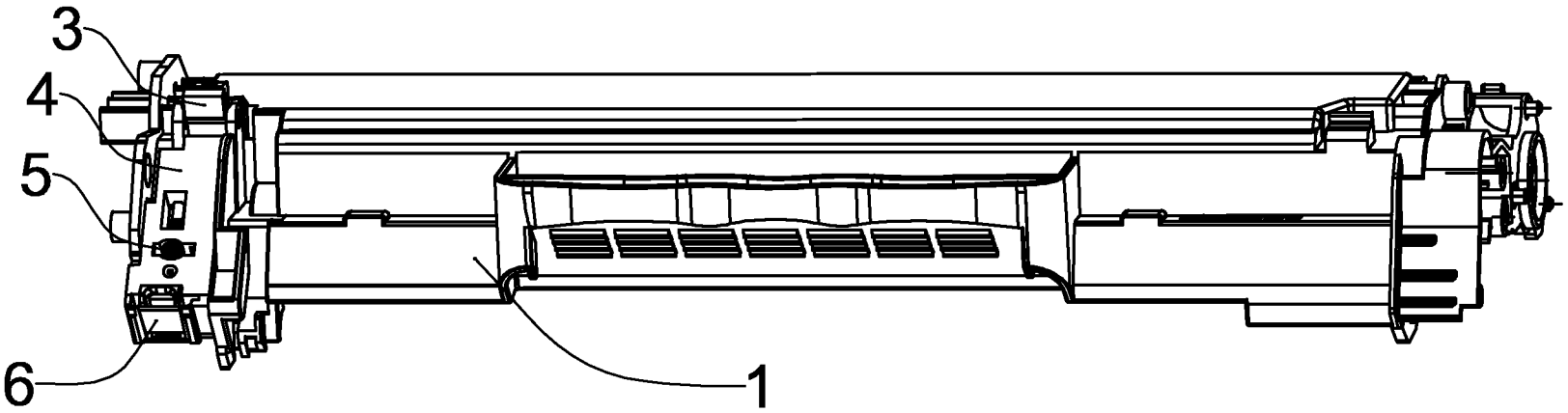
FIG. 7 is a perspective view of the developer cartridge shown in FIG. 1 when the chip contact mechanism is on the initial position.
Figure 8:
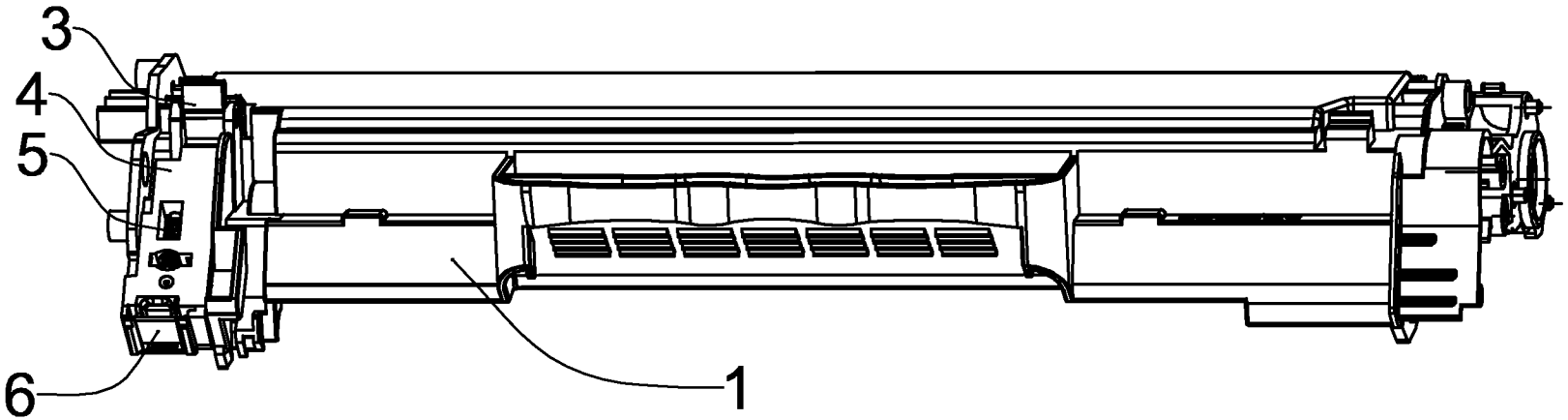
FIG. 8 is a perspective view of the developer cartridge shown in FIG. 1 when the chip contact mechanism is on the working position.

FIG. 5 and FIG. 7 show the state of the chip contact mechanism 2 before the developer cartridge is installed into the printer; at this time, the chip holder 4 is in the chip non-contact position and the chip 6 on the chip installation position 41 is not in contact with the contact of the printer. As shown in FIG. 6 and FIG. 8, when the developer cartridge is installed into the printer and the printer cover is closed, the printer cover pushes the lever 3 down, and the lever 3 rotates and pushes the chip holder 4 to slide forward against the spring force to the chip contact position. The chip 6 on the chip installation position 41 is thus in contact with the contact of the printer, and the developer cartridge starts to work. When the printer cover is opened, the chip holder 4 returns to the initial state by the force of the spring 5 and the chip 6 on the chip installation position 41 leaves the contact of the printer, and the developer cartridge can be easily removed. This design enables the chip to be in contact with the contact of the printer by the mechanical structure and prevents the contact of the printer from being damaged by excessive impact when the developer cartridge is installed.

The above preferred embodiments are used to illustrate the present invention and they can be varied or improved by persons of ordinary skills in the art. These variations or improvements will still fall within the spirit of the present invention and protection of the claims.

INDUSTRIAL APPLICABILITY

The developer cartridge and the chip contact mechanism of the present invention may be commercially manufactured and used, thus possesses industrial applicability.

What is claimed is:

1. A chip contact mechanism for a developer cartridge, comprising a chip holder movably provided on a cartridge body of the developer cartridge and a lever rotatably disposed on the cartridge body for enabling the chip holder to move, the chip holder having a chip installation position, and a return member being provided between the chip holder and the cartridge body;

wherein the lever is hinged with the cartridge body and abuts against the chip holder; when an external force is applied to the lever, the lever rotates from an initial position to a working position while pushing the chip holder to move from a chip non-contact position to a chip contact position; and when the external force is released, the chip holder moves back from the chip contact position to the chip non-contact position by the return member while pushing the lever to rotate from the working position to the initial position;

wherein the cartridge body is provided with a sliding groove engaging with the chip holder; the chip holder is provided slidably within the sliding groove; both sides of the chip holder are provided with guiding pins; both sides of the sliding groove are provided with guide rails engaging with the guiding pins; and the sliding groove is provided with a restricting block above the chip holder to prevent the chip holder from leaving the sliding groove.

2. The chip contact mechanism according to claim 1, wherein the return member is a spring; the chip holder comprises a spring base board; the spring base board is provided with a spring positioning post extending from the spring base board; the spring is disposed around the spring positioning post; a rear end of the spring presses against the spring base board or is fixed on the spring positioning post; and a front end of the spring presses against a spring baffle plate projecting on the cartridge body.

3. A developer cartridge, comprising a cartridge body and a chip contact mechanism, wherein the chip contact mechanism comprises a chip holder movably provided on the cartridge body and a lever rotatably disposed on the cartridge body for enabling the chip holder to move; and wherein the chip holder has a chip installation position and a return member is provided between the chip holder and the cartridge body;

wherein the lever is hinged with the cartridge body and abuts against the chip holder; when an external force is applied to the lever; the lever rotates from an initial position to a working position while pushing the chip holder to move from a chip non-contact position to a chip contact position; and when the external force is released, the chip holder moves back from the chip contact position to the chip non-contact position by the return member while pushing the lever to rotate from the working position to the initial position;

wherein the cartridge body is provided with a sliding groove engaging with the chip holder; the chip holder is provided slidably within the sliding groove; both sides of the chip holder are provided with guiding pins; both sides of the sliding groove are provided with guide rails engaging with the guiding pins; and the sliding groove is provided with a restricting block above the chip holder to prevent the chip holder from leaving the sliding groove.

4. The developer cartridge according to claim 3, wherein the return member is a spring; the chip holder comprises a spring base board; the spring base board is provided with a spring positioning post extending from the spring base board; the spring is disposed around the spring positioning post; a rear end of the spring presses against the spring base board or is fixed on the spring positioning post; and a front end of the spring presses against a spring baffle plate projecting on the cartridge body.

* * * * *